US008489007B2

(12) United States Patent
Fujiwara et al.

(10) Patent No.: US 8,489,007 B2
(45) Date of Patent: Jul. 16, 2013

(54) FIXING DEVICE

(75) Inventors: Yasushi Fujiwara, Itami (JP); Tsuneo Fujiwara, legal representative, Itami (JP); Etsuko Fujiwara, Itami (JP); Kei Ishida, Nagoya (JP); Noboru Suzuki, Komaki (JP); Yoshihiro Miyauchi, Ama (JP); Tomohiro Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 168 days.

(21) Appl. No.: 12/915,206

(22) Filed: Oct. 29, 2010

(65) Prior Publication Data

US 2011/0150543 A1 Jun. 23, 2011

(30) Foreign Application Priority Data

Oct. 30, 2009 (JP) ..... 2009-250226

(51) Int. Cl.
*G03G 15/20* (2006.01)

(52) U.S. Cl.
USPC ..... 399/329

(58) Field of Classification Search
USPC ..... 399/328, 329
See application file for complete search history.

(56) References Cited

U.S. PATENT DOCUMENTS

| | | | | |
|---|---|---|---|---|
| 5,083,168 | A | 1/1992 | Kusaka et al. | |
| 5,162,634 | A | 11/1992 | Kusaka et al. | |
| 5,262,834 | A | 11/1993 | Kusaka et al. | |
| 7,773,931 | B2 * | 8/2010 | Jung et al. | 399/329 |
| 7,792,476 | B2 | 9/2010 | Seol et al. | |
| 7,805,102 | B2 | 9/2010 | Kato | |
| 7,881,650 | B2 | 2/2011 | Shin et al. | |
| 8,032,069 | B2 | 10/2011 | Shin et al. | |
| 8,107,871 | B2 * | 1/2012 | Finn et al. | 399/334 |
| 2008/0187372 | A1 | 8/2008 | Kato | |
| 2008/0232871 | A1 | 9/2008 | Jung et al. | |

(Continued)

FOREIGN PATENT DOCUMENTS

| | | | |
|---|---|---|---|
| CN | 101221400 | A | 7/2008 |
| CN | 101344747 | A | 1/2009 |

(Continued)

OTHER PUBLICATIONS

English translated Notification of First Office Action, date of issue Jun. 28, 2012, in CN application 201010535959.7.

(Continued)

*Primary Examiner* — David Gray
*Assistant Examiner* — Gregory H Curran
(74) *Attorney, Agent, or Firm* — Banner & Witcoff, Ltd.

(57) ABSTRACT

In a fixing device, a nip plate is disposed on an inner surface of a tubular flexible fusing member which is flexibly deformable, and configured to be heated by a heating element disposed inside the fusing member. The fusing member is nipped between the nip plate and a backup member to form a nip portion. First and second portions of the nip plate which are located in positions upstream and downstream, respectively, with respect to a recording sheet conveyance direction and to be supported by a stay are each configured to be a flat plate extending along the recording sheet conveyance direction. A central portion between the first and second portions of the nip plate is in a position shifted from those of the first and second portions in a direction perpendicular to flat surfaces of the first and second portions.

18 Claims, 7 Drawing Sheets

U.S. PATENT DOCUMENTS

| | | | | |
|---|---|---|---|---|
| 2008/0317517 | A1 | 12/2008 | Suzuki et al. | |
| 2008/0317527 | A1* | 12/2008 | Seol et al. | 399/331 |
| 2009/0092423 | A1 | 4/2009 | Shin et al. | |
| 2009/0208264 | A1 | 8/2009 | Fujiwara et al. | |
| 2011/0091254 | A1 | 4/2011 | Shin et al. | |

FOREIGN PATENT DOCUMENTS

| | | | |
|---|---|---|---|
| CN | 101515152 | A | 8/2009 |
| EP | 0372479 | B1 | 6/1990 |
| EP | 2006749 | A2 | 12/2008 |
| EP | 2045671 | A1 | 4/2009 |
| JP | 2003-208041 | A | 7/2003 |
| JP | 2003217816 | A | 7/2003 |
| JP | 2003-257592 | A | 9/2003 |
| JP | 2004054072 | A | 2/2004 |
| JP | 2004-093842 | A | 3/2004 |
| JP | 2006-047769 | | 2/2006 |
| JP | 2007057851 | A | 3/2007 |
| JP | 2008-233886 | | 10/2008 |
| JP | 2008-233900 | | 10/2008 |
| JP | 2009-093141 | A | 4/2009 |

OTHER PUBLICATIONS

Extended European Search Report, mail date of Jul. 4, 2012, in EP application 10013604.3.

Notification of Reasons for Refusal issued in corresponding Japanese Patent Application No. 2009-250226 mailed Mar. 26, 2013.

* cited by examiner

FIXING DEVICE

CROSS-REFERENCE TO RELATED APPLICATION(S)

This application claims priority from Japanese Patent Application No. 2009-250226 filed on Oct. 30, 2009, the disclosure of which is incorporated herein by reference in its entirety.

FIELD

Apparatuses consistent with one or more aspects of the present invention relate to a fixing device for thermally fixing a developer image transferred onto a recording sheet.

BACKGROUND

A fixing device for use in an electrophotographic image forming apparatus is known in the art, in which a fusing film is nipped between a backup member (e.g., pressure roller) and a nip plate as a heating plate heated by a heater to thereby form a nip portion between the backup member and fusing film interposed between the backup member and the nip plate, and a holding member (e.g., stay) is provided to hold the heater and the nip plate. One example of the nip plate is a bent plate shaped like a letter U in cross section, such that sidewall portions of the U-shaped nip plate are fitted in stepped portions formed on insides of wall portions of a U-shaped stay (holding member). Thus, end faces of the sidewall portions of the nip plate are in contact with surfaces opposite thereto of the stepped portions of the stay so that a pressing force applied to the nip plate by a pressure roller (backup member) is transmitted through the end faces of the sidewall portions of the nip plate and received by the stay.

In the fixing device as mentioned above, however, the nip plate is supported with its very small areas of the end faces abutted on the stay, and the end faces of sidewall portions of the nip plate would possibly become slipped off the stepped portions of the stay. It would thus be desirable to provide a fixing device in which the nip plate is supported on the stay in a more reliable manner.

SUMMARY

In one aspect of the present invention, a fixing device for thermally fixing a developer image transferred onto a recording sheet is provided. The fixing device includes a tubular flexible fusing member which is flexibly deformable, a heating element disposed inside the fusing member, a nip plate disposed on an inner surface of the fusing member in such a manner that permits the fusing member to slide along the nip plate, and configured to be heated by the heating element, a backup member configured such that the fusing member is nipped between the backup member and the nip plate to form a nip portion between the fusing member and the backup member, and a stay configured to support first and second portions of the nip plate located in positions upstream and downstream, respectively, with respect to a recording sheet conveyance direction. Each of the first and second portions of the nip plate is configured to be a flat plate extending along the recording sheet conveyance direction, and the nip plate has a central portion between the first and second portions, which central portion is in a position shifted from those of the first and second portions in a direction perpendicular to flat surfaces of the first and second portions.

BRIEF DESCRIPTION OF THE DRAWINGS

The above and other aspects, other advantages and further features of the present invention will become more apparent by describing in detail illustrative, non-limiting embodiments thereof with reference to the accompanying drawings, in which.

DESCRIPTION OF EMBODIMENTS

A detailed description will be given of illustrative embodiments of the present invention with reference to the drawings. In the following description, a general setup of a laser printer 1 (image forming apparatus) with a fixing device 100 according to one embodiment of the present invention will be described at the outset, and then features of the fixing device 100 will be described in detail.

<General Setup of Laser Printer>

Figure 1:
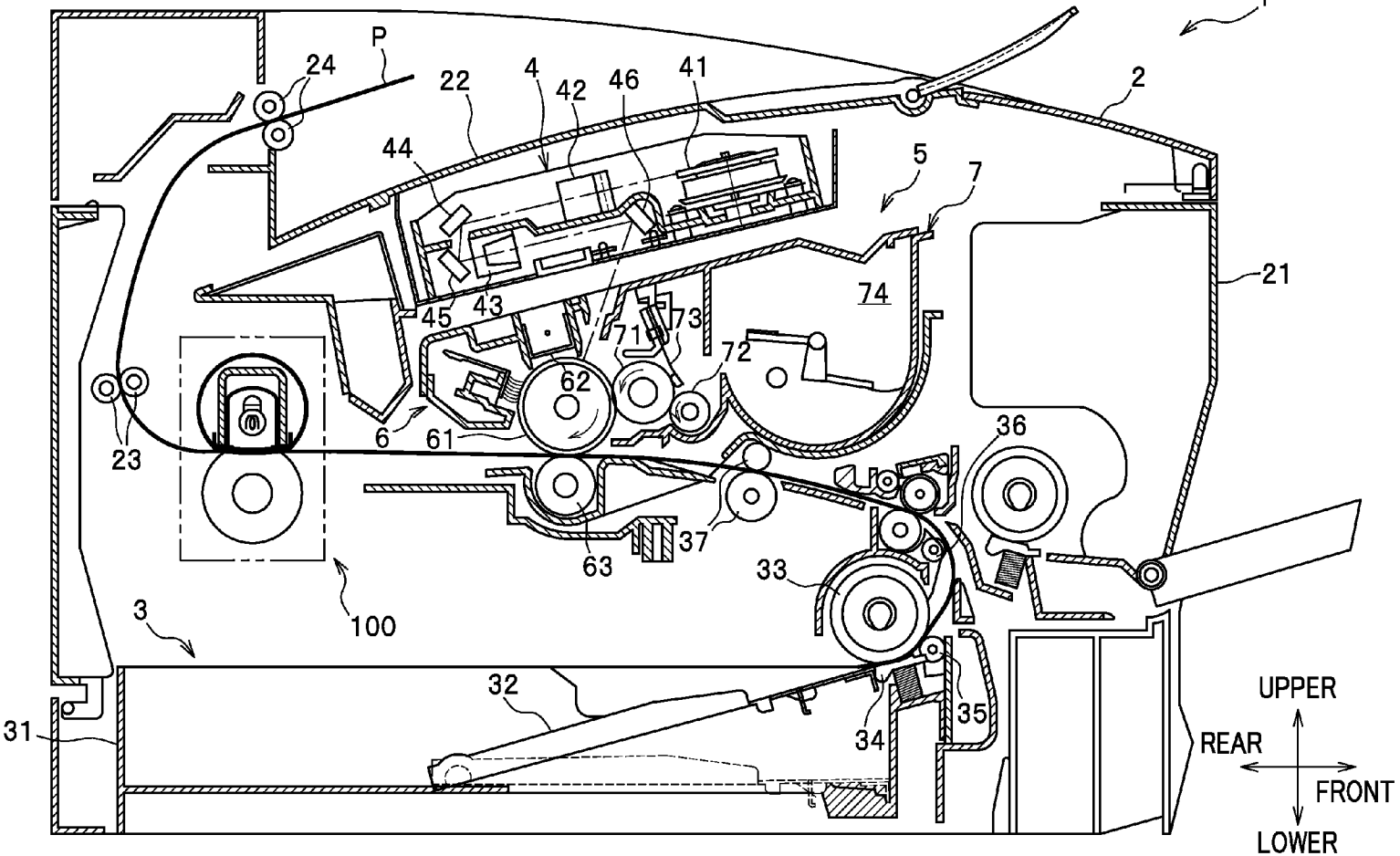
FIG. 1 is a schematic diagram of a laser printer with a fixing device according to an exemplary embodiment of the present invention.

As shown in FIG. 1, a laser printer 1 comprises a body casing 2, and several components housed within the body casing 2 which principally include a sheet feeder unit 3 for feeding a sheet P (e.g., of paper) as one example of a recording sheet, an exposure device 4, a process cartridge 5 for transferring a toner image (developer image) onto the sheet P, and a fixing device 100 for thermally fixing the toner image transferred onto the sheet P.

Hereinbelow, in describing the arrangement and operation of each component in the laser printer 1, the direction is designated as from the viewpoint of a user who is using (operating) the laser printer 1. To be more specific, in FIG. 1, the right-hand side of the drawing sheet corresponds to the "front" side of the printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction of a line extending from top to bottom of the drawing sheet corresponds to the "vertical" or "up/down (upper/lower or top/bottom)" direction of the printer.

The sheet feeder unit 3, provided in a lower space within the body casing 2, principally includes a sheet feed tray 31 for storing sheets P, a sheet pressure plate 32 for pushing up front sides of the sheets P, a sheet feed roller 33, a sheet feed pad 34, paper powder remover rollers 35, 36, and registration rollers 37. Sheets P in the sheet feed tray 31 are pressed against the sheet feed roller 33 by the sheet pressure plate 32, and each sheet P, separated from the others by the sheet feed roller 33 and the sheet feed pad 34, is conveyed through the paper powder remover rollers 35, 36 and the registration roller 37 into the process cartridge 5.

The exposure device 4 is provided in an upper space within the body casing 2, and principally includes a laser beam emitter (not shown), a polygon mirror 41 configured to be driven to spin, lenses 42, 43, and reflecting mirrors 44, 45, 46. The exposure device 4 is configured to cause a laser beam produced based upon image data to travel along a path indicated by alternate long and short dashed lines, by reflecting or transmitting the same at the polygon mirror 41, the lens 42, the reflecting mirrors 44, 45, the lens 43, and the reflecting mirror 46 in this order, so that a peripheral surface of a photoconductor drum 61 is rapidly scanned and illuminated consecutively with the laser beam.

The process cartridge 5 is disposed below the exposure device 4 within the body casing 2, and configured to be installable in and removable from the body casing 2 through an opening formed when a front cover 21 provided at the body casing 2 is swung open. The process cartridge 5 includes a drum unit 6 and a development unit 7.

The drum unit 6 principally includes a photoconductor drum 61, a charger 62 and a transfer roller 63. The development unit 7 is configured to be detachably attached to the drum unit 6. The development unit 7 principally includes a development roller 71, a supply roller 72, a doctor blade 73, and a toner reservoir 74 which is configured to store toner (developer) therein.

In the process cartridge 5, the peripheral surface of the photoconductor drum 61 is uniformly charged by the charger 62, and then exposed to a rapidly sweeping laser beam from the exposure device 4 so that an electrostatic latent image based upon image data is formed on the photoconductor drum 61. Meanwhile, toner in the toner reservoir 74 is supplied via the supply roller 72 to the development roller 71, and goes through between the development roller 71 and the doctor blade 73 so that a thin layer of toner having a predetermined thickness is carried on the development roller 71.

The toner carried on the development roller 71 is supplied to the electrostatic latent image formed on the photoconductor drum 61. Accordingly, the electrostatic latent image is visualized and a toner image is formed on the photoconductor drum 61. Thereafter, while a sheet P is conveyed through between the photoconductor drum 61 and the transfer roller 63, the toner image on the photoconductor drum 61 is transferred onto the sheet P.

The fixing device 100 is provided rearwardly of the process cartridge 5. The toner image (toner) transferred onto the sheet P is thermally fixed on the sheet P while passing through the fixing device 100. The sheet P with the toner image thermally fixed thereon is ejected by conveyor rollers 23, 24 onto a sheet output tray 22.

<Detailed Structure of Fixing Device>

Figure 2:
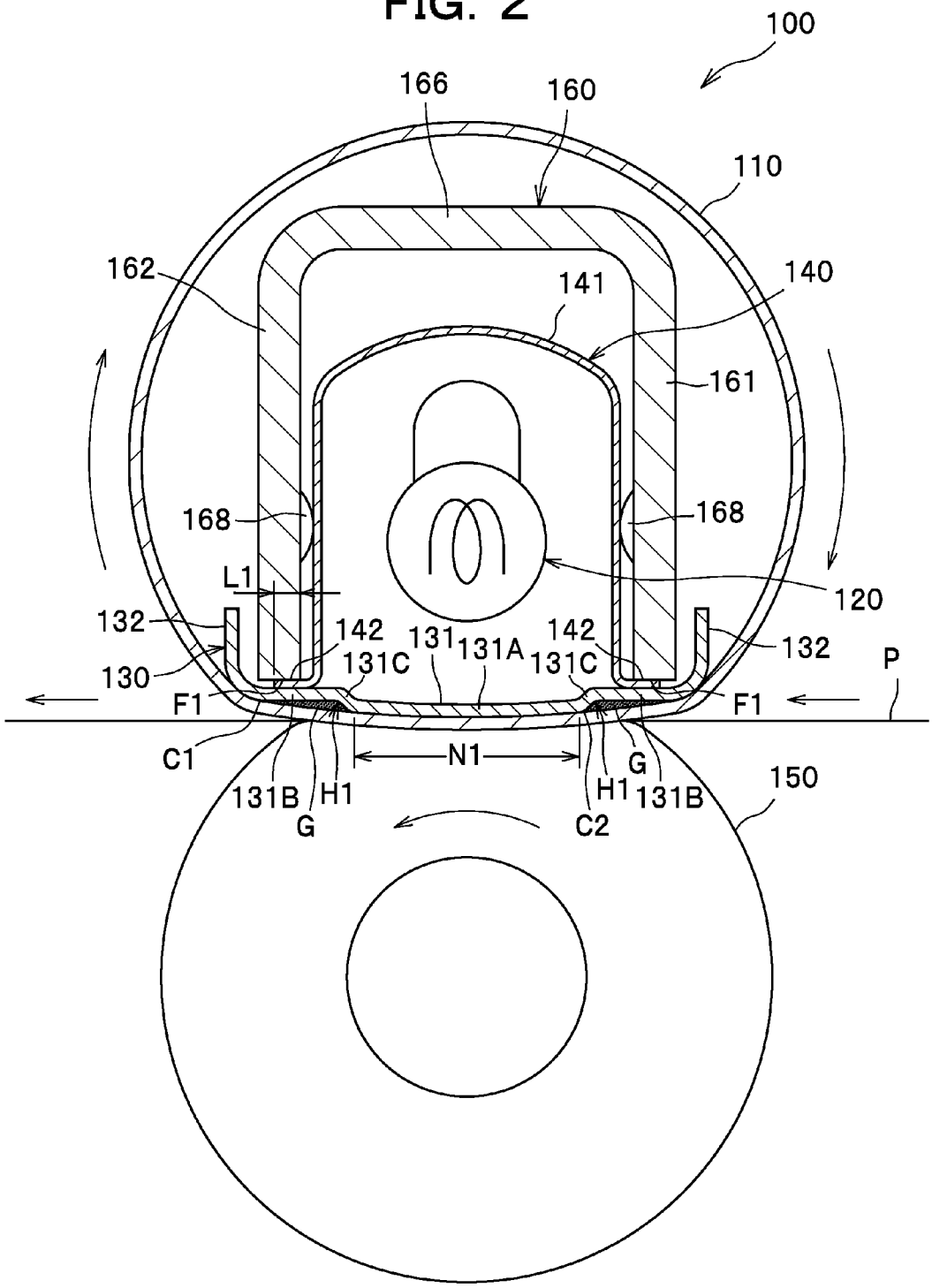
FIG. 2 is a schematic section of a fixing device according to an exemplary embodiment of the present invention.

As shown in FIG. 2, the fixing device 100 principally includes a fusing film 110 as one example of a fusing member, a halogen lamp 120 as one example of a heating element, a nip plate 130 as one example of a nip frame, a reflecting plate 140, a pressure roller 150 as one example of a backup member, and a stay 160.

In the following description, a direction of conveyance of a sheet P (substantially aligned with the front-rear direction) will be referred to simply as "sheet conveyance direction", and a direction along a width of a sheet P as conveyed (substantially aligned with the left-right direction) will be referred to simply as "sheet width direction". A direction of a pressing force applied from the pressure roller 150 (substantially aligned with the vertical/upward-downward direction) will be referred to simply as "pressing direction".

The fusing film 110 is an endless (tubular) film having thermostability and flexibility. Rotation of the fusing film 110 is guided by a guide member (not shown) provided at both end portions of the fusing film 110 of which the lengthwise direction is aligned with the sheet width direction.

The halogen lamp 120 is a known heating element configured to heat the nip plate 130 and the fusing film 110 to thereby heat toner on the sheet P. The halogen lamp 130 is disposed inside the fusing film 110, and spaced a predetermined distance apart from inner surfaces of fusing film 110 and the nip plate 130. The halogen lamp 120 in this embodiment includes a glass tube, and a resistance heating element disposed inside the glass tube.

The nip plate 130 is a member shaped like a plate configured to receive a pressing force of the pressure roller 150 and to transmit radiant heat from the halogen lamp 120 through the fusing film 110 to the toner on the sheet P. The nip plate 130 is disposed on the inner surface of the fusing film 110 in such a manner that permits the fusing film 110 to slide along the nip plate 130. The nip plate 130 is in contact with the fusing film 110 with lubricant G (e.g., grease) applied between the nip plate 130 and the fusing film 110 so as to make the fusing film 110 smoothly slidable.

The nip plate 130 has a thermal conductivity greater than the stay 160 made of steel which will be described later. The nip plate 130 is formed, for example, by bending an aluminum plate or the like into a shape with substantially U-shaped cross section. To be more specific, the nip plate 130 principally includes a base portion 131 and riser portions 132. The base portion 131 is disposed between the riser portions 132 and extends along the sheet conveyance direction. The nip plate 130 is bent at front and rear edges of the base portion 131 (located upstream and downstream, respectively, with respect to the sheet conveyance direction) and extends upward, and portions extending upward from the front and rear edges of the base portion 131 constitute the riser portions 132. In the present embodiment, the nip plate 13 is bent at its front and rear ends to form the riser portions 132 for the purposes of increasing the rigidity of the base portion 131, and preventing abrasion of the fusing film 110 at the edges of the nip plate 130, but the present invention is not limited to this specific configuration. It is to be understood that the riser portions 132 may be omitted.

The base portion 131 includes a central portion 131A and front and rear portions (first and second portions or upstream and downstream portions) 131B. The central portion 131A is located between the front and rear portions 131B, and the front and rear portions 131B are located in positions upstream and downstream, respectively, with respect to the sheet conveyance direction. The central portion 131A is in a position shifted from those of the front and rear portions 131B in a direction perpendicular to flat surfaces of the front and rear portions 131B extending along the sheet conveyance direction. To be more specific, the base portion 131 is bent and made downwardly convex or swelled out so that the central portion 131A is located in a position shifted closer to the pressure roller 150 relative to those of the front and rear portions 131B. To illustrate, the base portion 131 is shaped, by bending, into a hat-like profile such that the central portion 131A is offset downwardly from the front and rear portions 131B. By bending in this way, connecting portions 131C are formed which extend from inner edges of the front and rear portions 131B obliquely downward (toward the pressure roller 150) and connect with the central portion 131A.

A bent portion of the base portion 131, provided by the front or rear portion 131B extending along the sheet conveyance direction and the corresponding connecting portion 131C extending obliquely downwardly from the inner edge of the front or rear portion 131B, is designed to be curved further back than the central portion 131A relative to the fusing film 110, to thereby form a gap or a recessed portion H1 which opens on the inner surface of the fusing film 110. That is, two recessed portions H1 are formed in the base portion 131, in positions adjacent to both edges, upstream and downstream in the sheet conveyance direction, of the central portion 131A.

Lubricant G is held in each recessed portion H1. The lubricant G serves to reduce contact resistance between the fusing film 110 and the nip plate 130, so that the fusing film 110 can be slid on the nip plate 130 and rotated smoothly. As the lubricant G, for example, a heat-resistant fluoric grease may be adopted.

The recessed portion H1 is located outside a region, of the nip plate 130, corresponding to a nip portion N1. Here, the nip portion N1 refers to an interface between a portion of the fusing film 110 in contact with the central portion 131A of the base portion 131 and the pressure roller 150. Since the recessed portion H1 is not located within the region corresponding to the nip portion N1 that serves to thermally fix a toner image on the sheet P, an area of the nip plate 130 through which heat can be transmitted directly to the fusing film 110 can be maximized, and thus the thermal efficiency of the device 100 with respect to heat conducted through the nip portion N1 to the sheet P is increased.

A lubricant-holding space formed between each recessed portion H1 and the fusing film 110 is shaped substantially like a triangle in cross section having three corners; at a corner C1, C2 (forward corner) of each recessed portion H1 located in a forward position in a direction of rotation of the fusing film 110, the fusing film 110 and the recessed portion H1 form an acute angle. As a result, lubricant G applied to the fusing film 110 at the recessed portion H1 is not scraped off at the exit-side corner (the corner C1, C2 located in the forward position in the direction of rotation of the fusing film 110) of the recessed portion H1. Therefore, the lubricant G can be applied sufficiently to the fusing film 110.

An inner surface (upper surface) of the base portion 131 may be painted black, or provided with a heat absorptive member. This makes the base portion 131 of the nip plate 130 more efficient in absorbing radiant heat from the halogen lamp 120.

The front and rear portions 131B of the base portion 131 are located outside the region of the base portion 131 corresponding to the nip portion N1, and each of the front and rear portions 131B is configured to be a flat plate extending along the sheet conveyance direction. Accordingly, flat areas (corresponding to pressure receiving surfaces F1 of the stay 160 which will be described later) of the front and rear portions 131B of the base portion 131 can be supported with the reflecting plate 140 interposed therebetween, stably by the pressure receiving surfaces F1 each designed to have a relatively large area. Here, the pressure receiving surfaces F1 are surfaces of the stay 160 which receive the pressing force from the pressure roller 150. Each pressure receiving surface F1 has a length L1 in the sheet conveyance direction.

Figure 3:
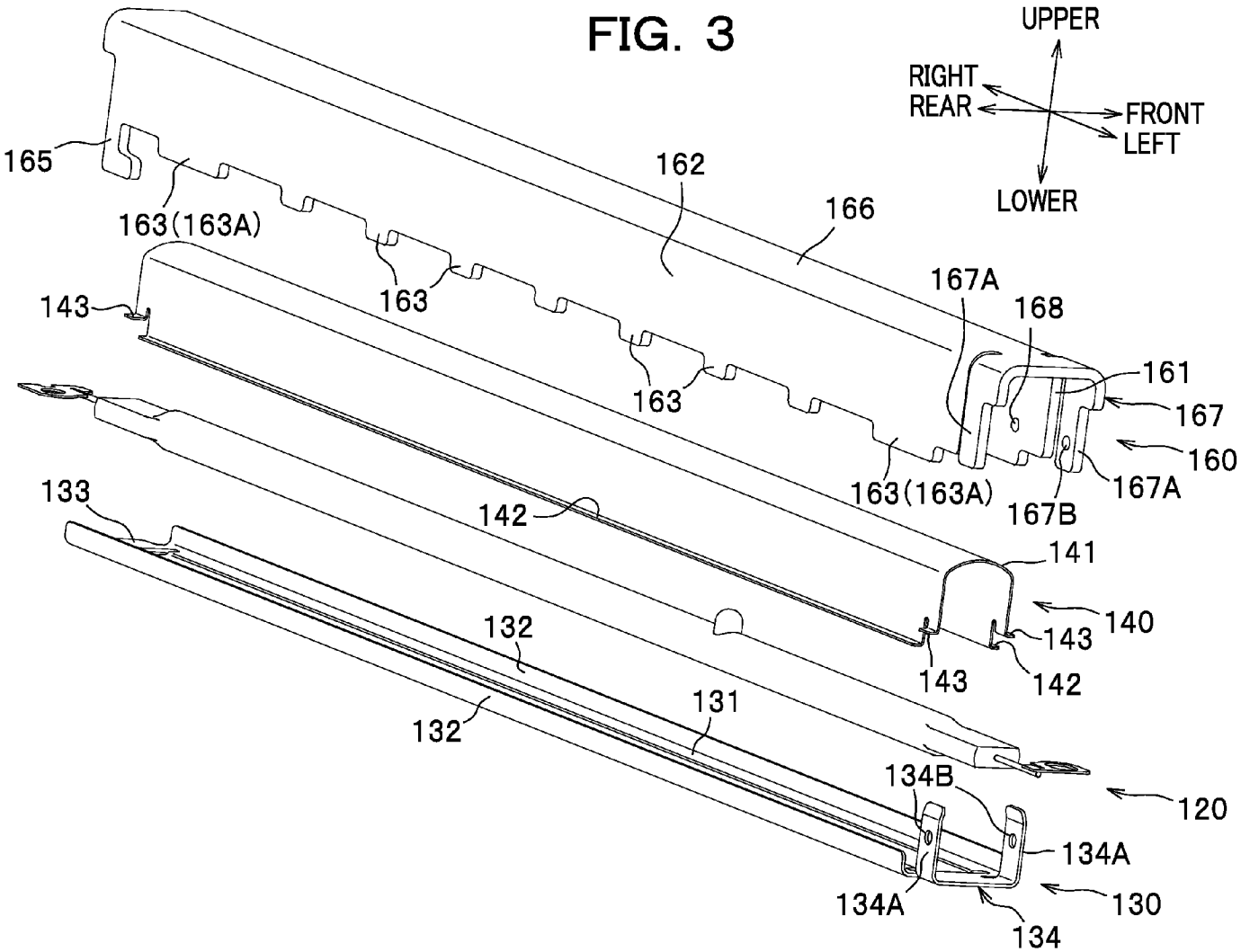
FIG. 3 is a perspective view showing a halogen lamp, a nip plate, a reflecting plate and a stay, as disassembled.

As shown in FIG. 3, the nip plate 130 includes an insertion portion 133 extending from a right end of the base portion 131, and an engagement portion 134 formed on a left end of the base portion 131. The engagement portion 134 is shaped like a letter U as viewed in cross section, and engageable holes 134B are provided in sidewall portions 134A formed by bending the engagement portion 134 upwardly.

As shown in FIG. 2, the reflecting plate 140 is a member configured to reflect radiation of heat from the halogen lamp 120 (radiant heat radiated mainly in the frontward, rearward and upward directions) toward the nip plate 130 (the inner surface of the base portion 131). The reflecting plate 140 is disposed inside the fusing film 110 to surround the halogen lamp 120, in a position spaced a predetermined distance apart from the halogen lamp 120.

The reflecting plate 140 is designed to collect radiant heat from the halogen lamp 120 to the nip plate 130, and thus the radiant heat from the halogen lamp 120 can be efficiently utilized so that the nip plate 130 and the fusing film 110 can be heated quickly.

The reflecting plate 140 is formed, for example, of an aluminum plate or the like having a high reflectance of infrared and far-infrared radiation by curving the same to have a U-shaped cross section. To be more specific, the reflecting plate 140 principally includes a reflecting portion 141 having a curved shape (in the shape of the letter U as viewed in cross section) and front and rear flange portions 142 extending from front and rear edges of the reflecting portion 141 upstream and downstream, respectively, along the sheet conveyance direction. In order to increase the reflectance of radiant heat, the reflecting plate 140 may be formed of a mirror-finished aluminum plate.

Figure 4:
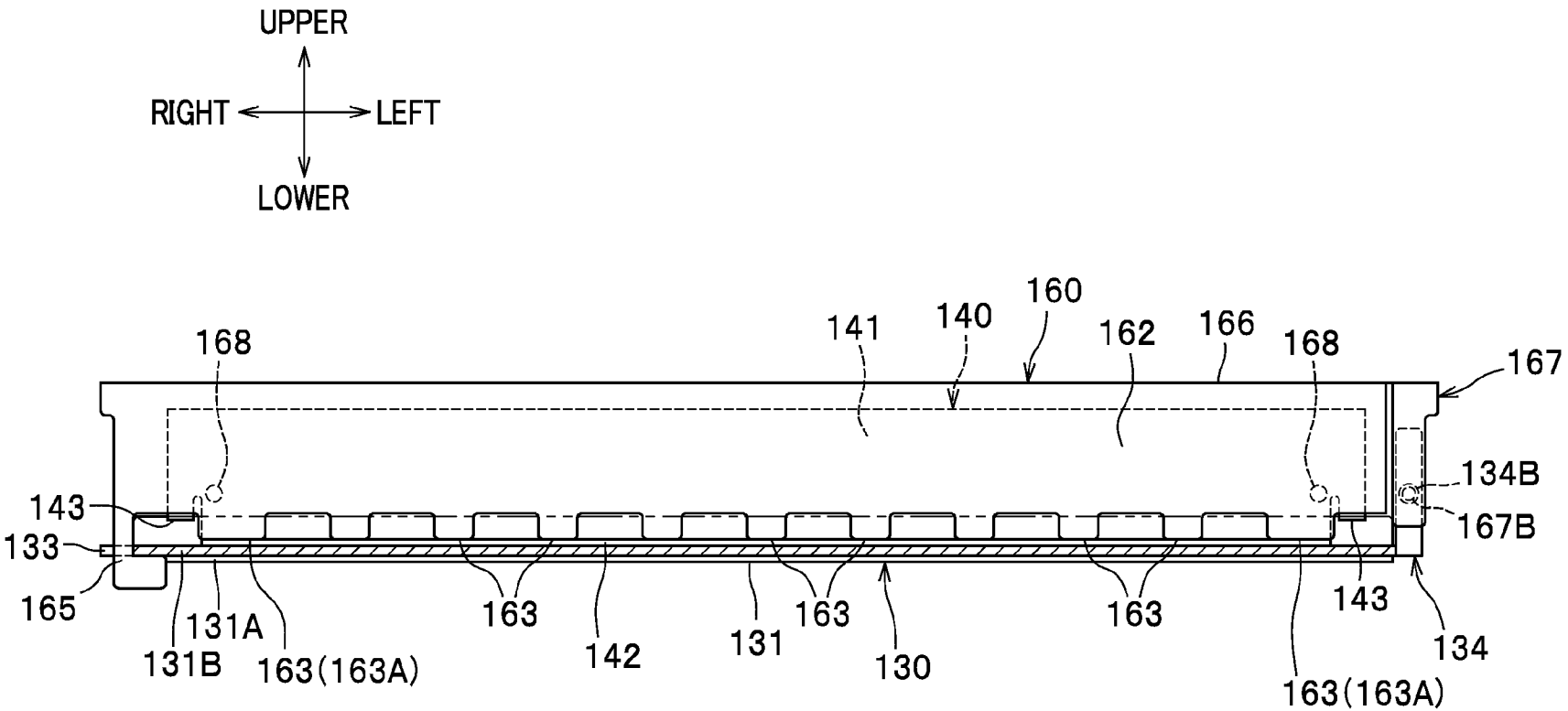
FIG. 4 shows the nip plate, the reflecting plate and the stay, as assembled, as viewed from a recording sheet conveyance direction.

As shown in FIG. 3, four stopper portions 143 (of which three are shown) each shaped like a flange are formed at right and left ends of the reflecting plate 140 of which the lengthwise direction is aligned with the sheet width direction (i.e., at the ends of the length of the transversely disposed reflecting plate 140). The stopper portions 143 are located above the flange portions 142, and designed such that, as shown in FIG. 4, when the nip plate 130, the reflecting plate 140 and the stay 160 are assembled together, a plurality of contact portions 163 of the stay 160 which will be described later are sandwiched between the stopper portions 143 (i.e., the stopper portions come in contact with outer sides of the outermost contact portions 163A of the contact portions arranged along the sheet width direction).

With this configuration, even when the reflecting plate 140 tends to move to the left or to the right by some reason such as vibrations produced during the operation of the fixing device 100, the reflecting plate 140 is restricted in its movements in the sheet width direction because the stopper portions 143 of the reflecting plate 140 come in contact with the respective contact portions 163A. As a result, an undesirable displacement of the reflecting plate 140 in the sheet width direction can be restricted effectively.

As shown in FIG. 2, the pressure roller 150 is configured such that the fusing film 110 is nipped between the pressure roller 150 and the nip plate 130 to form a nip portion N1 between the fusing film 110 and the pressure roller 150. The pressure roller 150 is disposed below the nip plate 130. To be more specific, the pressure roller 150 is configured to press the nip plate 130 through the fusing film 110 to thereby form the nip portion N1 between the fusing film 110 and the pressure roller 150.

The pressure roller 150 is configured to be driven to rotate by a driving force transmitted from a motor (not shown) provided in the body casing 2. Rotation of the pressure roller 150 causes the fusing film 110 to rotate, following the rotational movement of the pressure roller 150, with the help of frictional force with the fusing film 110 (or a sheet P as conveyed).

A sheet P with a toner image transferred thereon is conveyed through between the pressure roller 150 and the heated fusing film 110 (through the nip portion N1), so that the toner image (toner) is thermally fixed on the sheet P.

The stay 160 is configured to support the front and rear portions 131B of the nip plate 130 (the base portion 131 thereof) located in positions upstream and downstream, respectively, with respect to the sheet conveyance direction with its relatively large pressure receiving surfaces F1, to thereby reinforce the nip plate 130. The stay 160 is shaped to follow the contour of the reflecting plate 140 (the reflecting portion 141 thereof) and provided to sheathe the reflecting plate 140. The stay 160 like this may be formed, for example, by bending a steel plate or the like having a relatively great rigidity into a shape with substantially U-shaped cross section.

At a lower end portion of each of front and rear wall portions 161, 162 of the stay 160, as shown in FIG. 3, a plurality of contact portions 163 are provided which are shaped substantially like the teeth of a comb.

At the right end portion of each of the front and rear wall portions 161, 162 of the stay 160, a stopper portion 165 shaped substantially like a letter L is provided which extends downward from the lower side of the right end portion and then extends leftward. Furthermore, at the left end portion of the stay 160, a holding portion 167 is provided which is bent into a shape with substantially U-shaped cross section, having an upper wall extension portion extending leftward from an upper wall portion 166 of the stay 160 and front and rear apron portions 167A extending downwardly from front and rear edges of the upper wall extension portion. At an inner surface of each apron portion 167A of the holding portion 167, an engageable boss 167B is provided (only the engageable boss 167B of the front apron portion 167A is illustrated) which protrudes inwardly.

As shown in FIGS. 2 and 3, on inner surfaces of the front wall portion 161 and the rear wall portion 162, the total four abutment bosses 168 protruding inwardly are provided, at right and left end portions of front and rear wall portions 161, 162 of the stay 160 of which the lengthwise direction is aligned with the sheet width direction (i.e., at the ends of the length of the transversely disposed stay 160). These abutment bosses 168 abut on the reflecting plate 140 (the reflecting portion 141 thereof) from the upstream and downstream sides with respect to the sheet conveyance direction. With this configuration, even when the reflecting plate 140 tends to move to the front or to the rear by some reason such as vibrations produced during the operation of the fixing device 100, the reflecting plate 140 is restricted in its movements in the sheet conveyance direction because the abutment bosses 168 come in contact with the reflecting portion 141. As a result, an undesirable displacement of the reflecting plate 140 in the sheet conveyance direction can be restricted effectively.

When the reflecting plate 140 and the nip plate 130 are combined together with the stay 160 as described above, first, the reflecting plate 140 is fitted in the stay 160. Since the abutment bosses 168 are provided on the inner surfaces of the front wall portion 161 and the rear wall portion 162 of the stay 160, the abutment bosses 168 abut on the reflecting plate 140 so that the reflecting plate 140 is provisionally held inside the stay 160.

Thereafter, as shown in FIG. 4, the insertion portion 133 of the nip plate 130 is inserted between the stopper portions 165 so that the base portion 131 (front and rear portions 131B) engages with the stopper portions 165. Then, the engagement portion 134 (engageable holes 134B) of the nip plate 130 is engaged with the holding portion 167 (engageable bosses 167B) of the stay 160.

In this way, the nip plate 130 is supported on the stay 160 with the base portion 131 being supported by the stopper portions 165 and with the engagement portion 134 being held by the holding portion 167. The reflecting plate 140 is also supported on and held inside the stay 160 with the flange portions 142 being held between the nip plate 130 and the stay 160.

Although not illustrated in the drawings, the stay 160, on which the nip plate 130 and the reflecting plate 140 are supported, and the halogen lamp 120 are held by a guide member adapted to guide the rotation of the fusing film 110. This guide member is mounted in the casing (not shown) of the fixing device 100, so that the fusing film 110, the halogen lamp 120, the nip plate 130, the reflecting plate 140 and the stay 160 are held in the casing of the fixing device 100.

In the present embodiment, the reflecting plate 140 is, as shown in FIG. 2, supported with the flange portions 142 held between the nip plate 130 and the stay 160. With this configuration, even when the reflecting plate 140 tends to move upward or downward by some reason such as vibrations produced during the operation of the fixing device 100, the reflecting plate 140 is restricted in its movements in the pressing direction because the flange portions 142 are held between the nip plate 130 and the stay 160. As a result, an undesirable displacement of the reflecting plate 140 in the pressing direction can be restricted effectively so that the position of the reflecting plate 140 relative to the nip plate 130 can be fixed securely.

With the configuration as described above according to the present embodiment, the following advantageous effects can be achieved.

Since each of the front and rear portions 131B of the nip plate 130 (base portion 131) is configured to be a flat plate extending along the sheet conveyance direction, the flat surfaces of the front and rear portions 131B of the nip plate 130 can be supported by the relatively large pressure receiving surfaces F1 of the stay 160. Accordingly, the nip plate 130 is rendered unlikely to slip off the stay 160, so that the nip plate 130 can be supported by the stay 160 with increased reliability.

Since the central portion 131A of the nip plate 130 is in a position shifted from those of the front and rear portions 131B in the direction perpendicular to the flat surfaces of the front and rear portions 131B (i.e., the nip plate 130 (the base portion 131 thereof) is shaped like a hat), the number of bent portions in the nip plate 130 is increased as compared with the conventional U-shaped nip plate, so that the rigidity of the nip plate 130 is enhanced. Accordingly, the nip plate 130 can be made thinner while maintaining the rigidity comparable to that of the conventional nip plate, and thus the nip plate 130 may be designed to have a smaller heat capacity so that the nip plate 130 can be heated more quickly.

Since the position in which the central portion 131A of the nip plate 130 is located is a position shifted closer to the pressure roller 150 relative to those of the front and rear portions 131B, the pressing force from the pressure roller 150 can be received well by the thus-swelled central portion so that a desirable nip portion N1 can be formed between the fusing film 110 and the pressure roller 150.

Since the recessed portions H1 designed to hold a lubricant G are formed by bending the nip plate 130, the nip plate 130 can be configured to be of a thinner plate having a smaller heat capacity, as compared with a conventional thicker pressure pad having a hollow formed to hold a lubricant therein. Accordingly, the nip plate 130 can be heated more quickly than the conventional thicker pressure pad; as a result, lubricant G held therein can also be heated quickly by heat transmitted from the nip plate 130 and thus the viscosity thereof can be lowered quickly to an adequate level.

In particular, even when the fixing device 100 is actuated under low-temperature conditions, for example, during wintertime or in cold climate areas, the lubricant G can be heated quickly, and thus upon startup of the fixing device 100 the friction between the fusing film 110 and the nip plate 130 can be reduced quickly, so that the fusing operation of the fixing device 100 upon startup can be performed in good condition.

Since reinforcement (increase in rigidity) of the nip plate 130 and formation of the recessed portions H1 for lubricant G therein can be achieved simultaneously by a simple operation of bending, the time required for fabrication of the nip plate 130 can be shortened.

Since each recessed portion H1 is located outside a region, of the nip plate 130, corresponding to the nip portion N1, a heat-conducting area in the nip portion N1 can be maximized, so that the thermal efficiency of the device 100 with respect to heat conducted through the nip portion N1 to a sheet P can be increased.

Since, of three corners of a cross-sectionally triangular space formed between each recessed portion H1 and the fusing film 110, the corner C1, C2 (a forward corner located in a forward position in a direction of rotation of the fusing film 110) is formed such that the fusing film 110 and the recessed portion H1 form an acute angle at that corner C1, C2, lubricant G can be applied adequately to the fusing film 110. In particular, since an acute angle is formed at the corner C2 of the space formed by the recessed portion H1 located upstream of the nip portion N1 in the direction of rotation of the fusing film 110, the lubricant G in the recessed portion H1 located upstream of the nip portion N1 can be fed forward sufficiently into the nip portion N1. Therefore, the contact resistance between the fusing film 110 and the nip plate 130 can be reduced effectively.

Although an illustrative embodiment of the present invention has been described above, the present invention is not limited to this specific embodiment. It is to be understood that modifications and changes may be made to any of the specific configurations without departing from the scope of the present invention as claimed in the appended claims.

Figure 5:
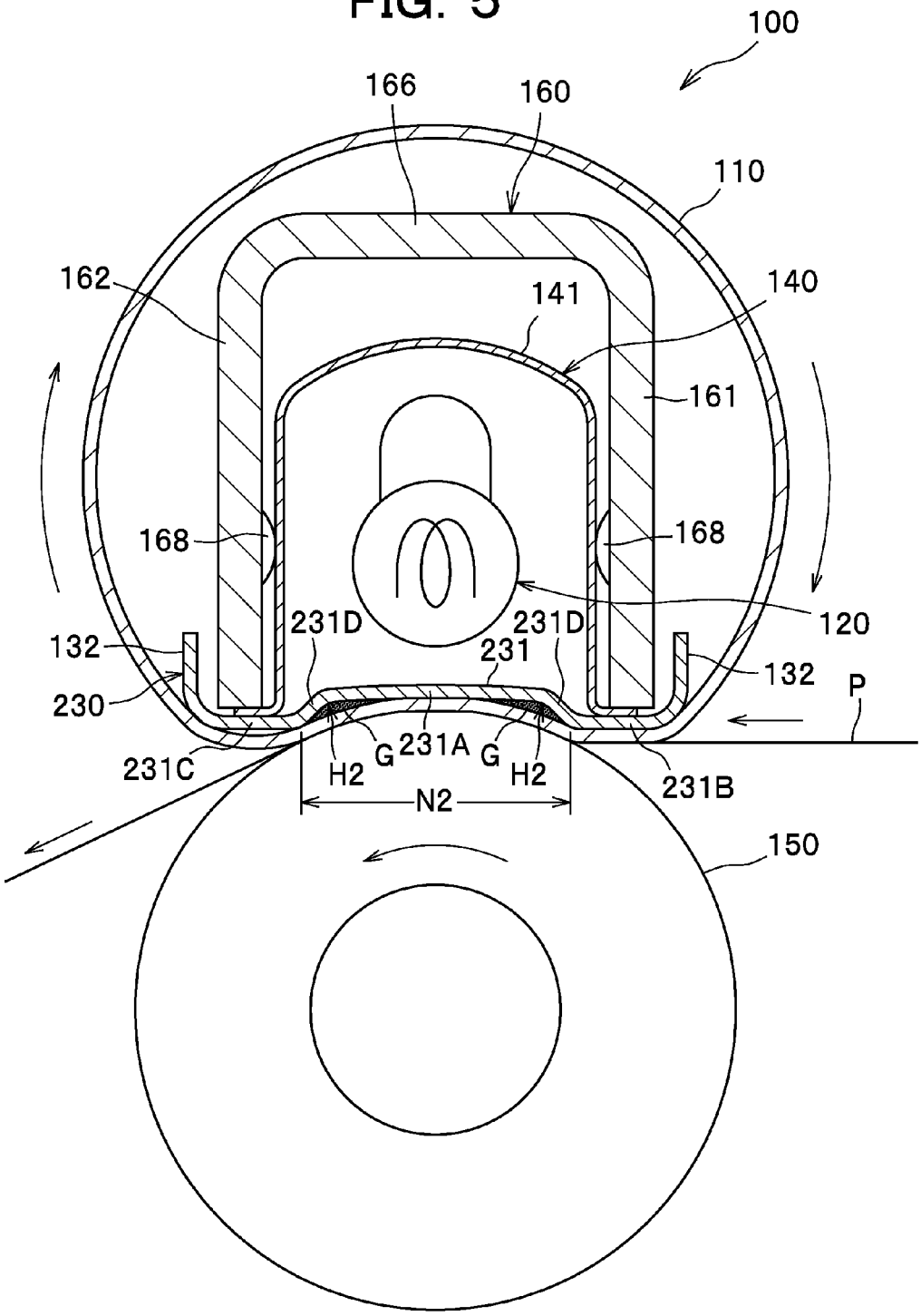
FIG. 5 is a schematic section of a fixing device according to a modified embodiment of the present invention, with a central portion of the nip plate bulged upward.

In the above-described embodiment, the central portion 131A of the nip plate 130 is located in a position shifted downward (closer to the pressure roller 150) relative to those of the front and rear portions 131B, but the present invention is not limited to this specific configuration. Alternatively, as shown in FIG. 5, a central portion 231A of a nip plate 230 (a base portion 231 thereof) may be located in a position shifted upward (closer to the halogen lamp 120) relative to those of front and rear portions 231B, 231C of the nip plate 230. In describing hereinbelow this alternative embodiment shown in FIG. 5, it is to be understood that the same elements are designated by the same reference characters, and a duplicate description thereof will be omitted.

With this configuration, the front portion 231B of the nip plate 230 located in a position upstream with respect to the sheet conveyance direction can be entirely brought into contact with the fusing film 110, and thus the fusing film 110 can be heated at the front portion 231B preliminarily before getting nipped (i.e., a portion of the fusing film 110 trailing just behind a nip portion N2 can be heated in advance). Consequently, the thermal efficiency of the device 100 with respect to heat conducted through the fusing film 110 to a sheet P can be increased, and thus the performance of its fusing operation can be improved.

Figure 6A:
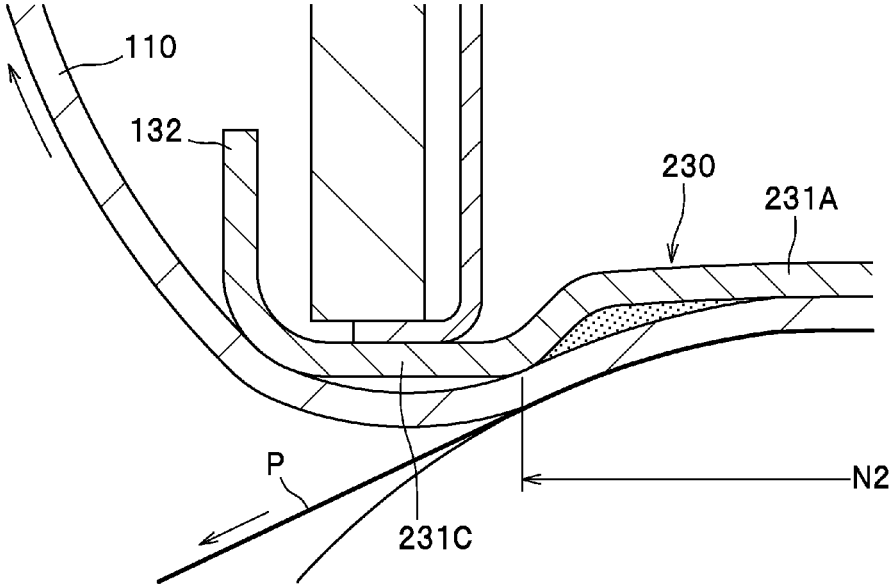
FIG. 6A is an enlarged view showing a rear portion of the nip plate of FIG. 5 located in a position downstream with respect to a recording sheet conveyance direction.

Since the rear portion 231C that is a portion of the nip plate 230 located in a position downstream with respect to the sheet conveyance direction is located in a position shifted downward relative to that of the central portion 231A, the fusing film 110 can be shaped to have a sharply curved portion (curved with a relatively small radius of curvature) around the rear portion 231C (i.e., a portion over the rear portion 231C and adjacent portions upstream and downstream from the rear portion 231) as shown in FIG. 6A.

Figure 6B:
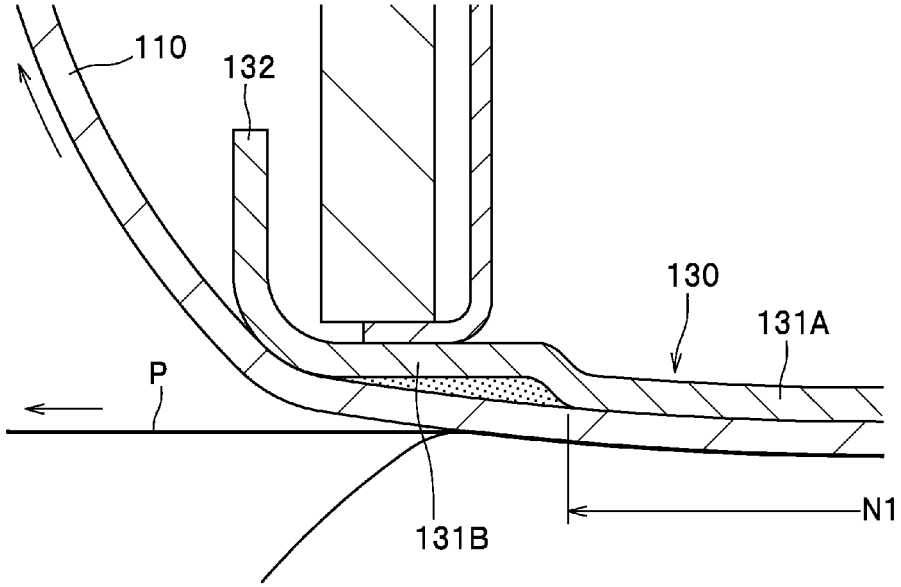
FIG. 6B is an enlarged view showing a rear portion of the nip plate of FIG. 2 located in a position downstream with respect to the recording sheet conveyance direction.

In contrast to the above-described embodiment of FIG. 2, in which the fusing film 110 having a relatively large radius of curvature is not sharply curved away from a sheet P (as an angle between the fusing film 110 and the sheet P is small) as shown in FIG. 6B, the alternative embodiment of FIG. 5 is configured to have the fusing film 110 sharply curved away from a sheet P (as an angle between the fusing film 110 and the sheet P is sharply getting greater) as shown in FIG. 6A. Therefore, with the embodiment shown in FIGS. 5 and 6A, a sheet P can be separated smoothly from the fusing film 110.

The nip plate 230 shown in FIG. 5 is of a single plate-like member which is bent to form the front and rear portions 231B, 231C and the central portion 231A as described above between the riser portions 132. The nip plate 230 (the base portion 231 thereof) further includes connecting portions 231D which extend from inner edges of the front and rear portions 231B, 231C obliquely upward (toward the halogen lamp 120) and connect with the central portion 231A. By bending in this way, in the embodiment shown in FIG. 5, a bent portion of the base portion 231, provided by the central portion 231A and each connecting portion 231D, is adapted to form a recessed portion H2 which holds a lubricant G.

The recessed portion H2 formed in this way is located inside a region, of the nip plate 230, corresponding to the nip portion N2. That is, the fusing film 110 is nipped between the nip plate 230 (at the inner edges of the front and rear portions 231B, 231C and a midsection of the central portion 231A thereof) and the pressure roller 150 so that the recessed portions H2 are located inside the region of the nip plate 230 corresponding to the nip portion N2.

With this configuration, in which each recessed portion H2 is located inside the region corresponding to the nip portion N2, the fusing film 110 is pressed against the lubricant G in the recessed portion H2, and thus the lubricant G can be applied sufficiently to the fusing film 110.

In the embodiment as shown in FIG. 5, as well, an acute angle is formed at a forward corner (one of three corners of a cross-sectionally triangular space formed between each recessed portion H2 and the fusing film 110) that is located in a forward position in the direction of rotation of the fusing film 110, and thus the advantageous effects mentioned in describing the above-described embodiment of FIG. 2 can also be achieved; for example, the contact resistance between the fusing film 110 and the nip plate 230 can be reduced effectively.

In the above-described embodiment, the reflecting plate 140 is provided, but the present invention is not limited to this specific configuration. In an alternative embodiment, the reflecting plate may not be provided.

In the above-described embodiment, the halogen lamp 120 (halogen heater) is taken as an example of a heating element, but the heating element consistent with the present invention is not limited thereto. For example, an infrared heater or a carbon heater may be adopted, instead.

Figure 7:
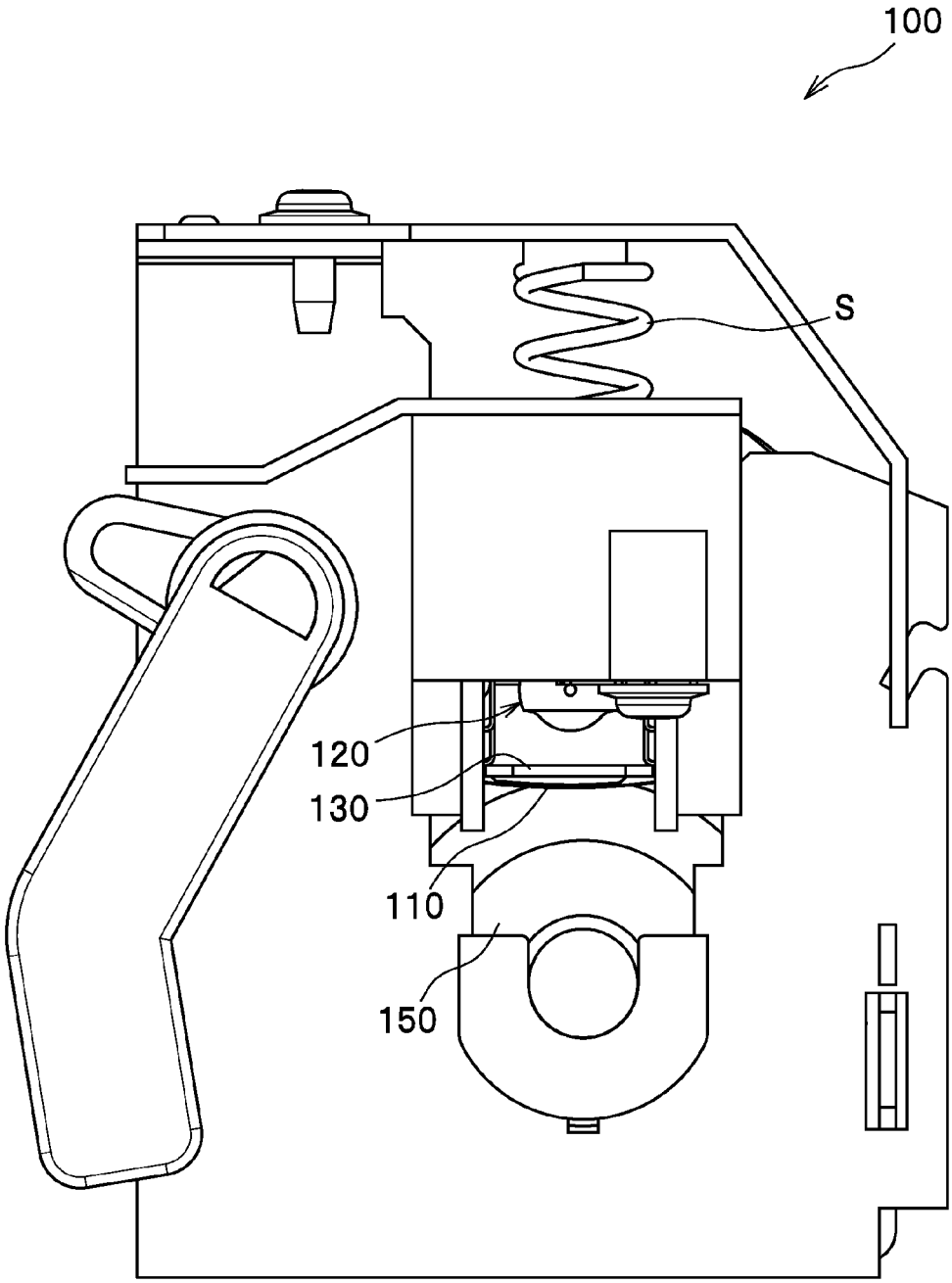
FIG. 7 is a schematic diagram of a fixing device to illustrate one example of a pressing mechanism consistent with the present invention.

In the above-described embodiment, the pressure roller 150 is taken as an example of a backup member, but the backup member consistent with the present invention is not limited thereto. For example, a belt-like pressure member may be adopted, instead. Furthermore, in the above-described embodiment, the pressure roller 150 (backup member) is pressed against the nip plate 130 to form a nip portion between the fusing film 110 and the pressure roller 150, but the present invention is not limited to this specific configuration. Instead, the nip portion of the fusing film may be formed by an alternative configuration in which the nip plate is pressed against the backup member. For example, in one embodiment, as shown in FIG. 7, the nip plate 130 may be pressed against the pressure roller 150 with the fusing film 110 nipped between the nip plate 130 and the pressure roller 150, with the help of a mechanical spring S.

In the above-described embodiment, the nip plate 130 is composed of a single plate-like member which is bent to form the central portion 231A between the front and rear portions 231B, but the present invention is not limited to this specific configuration. The nip plate consistent with the present invention may be an assembly of a nipping part (corresponding to the central portion 231A) and structural parts adapted to be supported by a stay (corresponding to front and rear portions 231B).

The fusing film or fusing member may be a film (e.g., of resin or metal), or a film of which an outer surface is covered with a rubber layer.

In the above-described embodiment, a sheet P (e.g., of paper) is taken as an example of a recording sheet, but the recording sheet consistent with the present invention is not limited thereto, and an OHP sheet or the like may be adopted.

In the above-described embodiment, the fixing device 100 is described as being included in the laser printer 1 by way of example. The present invention is however not limited to this example. Alternatively, the fixing device consistent with the present invention may be used in any other image forming apparatus such as photocopiers, multifunction peripherals, etc. Furthermore, the above-described embodiment describes a monochrome image forming apparatus, but the present invention is not limited thereto, but the image forming apparatus to which the fixing device according to the present invention is applicable may be a color image forming apparatus.

The invention claimed is:

1. A fixing device for thermally fixing a developer image transferred onto a recording sheet, comprising:

a tubular flexible fusing member which is flexibly deformable;

a heating element disposed inside the fusing member;

a nip plate disposed on an inner surface of the fusing member, and configured to be heated by the heating element;

a backup member configured such that the fusing member is nipped between the backup member and the nip plate to form a nip portion between the fusing member and the backup member; and a stay configured to support first and second portions of the nip plate located in positions upstream and downstream, respectively, with respect to a recording sheet conveyance direction, wherein each of the first and second portions of the nip plate is configured to be a flat plate extending along the recording sheet conveyance direction, the nip plate having a central portion between the first and second portions, wherein the central portion is in a position shifted from those of the first and second portions in a direction perpendicular to flat surfaces of the first and second portions, and wherein at least a portion of the first and second portions of the nip plate are located outside of a region of the nip plate corresponding to the nip portion.

2. The fixing device according to claim 1, wherein the nip plate is of a single plate-like member which is bent to form the central portion between the first and second portions.

3. The fixing device according to claim 1, wherein the position in which the central portion of the nip plate is located is closer to the backup member than the first and second portions.

4. The fixing device according to claim 1, wherein the position in which the central portion of the nip plate is located is closer to the heating element than the first and second portions.

5. The fixing device according to claim 1, wherein the nip plate has a first side facing the inner surface of the fusing member and a second side reverse to the first side; and wherein the first and second portions of the nip plate are supported by the stay at the second side of the nip plate.

6. The fixing device according to claim 5, wherein the stay is made from sheet metal and shaped substantially like a letter U as viewed in an axial direction of the tubular fusing member; and wherein surfaces of the first and second portions at the second side of the nip plate are disposed opposite to and supported by end faces of the stay, respectively, in an opposing direction of the backup member and the nip plate.

7. The fixing device according to claim 1, wherein the stay is made from sheet metal, and the nip plate has a thickness smaller than that of the stay.

8. The fixing device according to claim 1, further comprising a reflecting plate configured to reflect, toward the nip plate, radiation of heat received from the heating element, wherein each of the first and second portions of the nip plate is supported by the stay with the reflecting plate interposed between the each of first and second portions of the nip plate and the stay.

9. The fixing device according to claim 1, wherein the fusing member is a film.

10. A fixing device for thermally fixing a developer image transferred onto a recording sheet, comprising:

a tubular flexible fusing member which is flexibly deformable;

a heating element disposed inside the fusing member;

a nip plate disposed on an inner surface of the fusing member, and configured to be heated by the heating element;

a backup member configured such that the fusing member is nipped between the backup member and the nip plate to form a nip portion between the fusing member and the backup member; and a stay configured to support first and second portions of the nip plate located in positions upstream and downstream, respectively, with respect to a recording sheet conveyance direction, wherein each of the first and second portions of the nip plate is configured to be a flat plate extending along the recording sheet conveyance direction, the nip plate having a central portion between the first and second portions, wherein the central portion is in a position shifted from those of the first and second portions in a direction perpendicular to flat surfaces of the first and second portions, wherein the position in which the central portion of the nip plate is located is closer to the backup member than the first and second portions.

11. The fixing device according to claim 10, wherein the nip plate is of a single plate-like member which is bent to form the central portion between the first and second portions.

12. The fixing device according to claim 10, wherein the position in which the central portion of the nip plate is located is closer to the heating element than the first and second portions.

13. The fixing device according to claim 10, wherein at least a portion of the first and second portions of the nip plate are located outside of a region of the nip plate corresponding to the nip portion.

14. The fixing device according to claim 10, wherein the nip plate has a first side facing the inner surface of the fusing member and a second side reverse to the first side; and wherein the first and second portions of the nip plate are supported by the stay at the second side of the nip plate.

15. The fixing device according to claim 14, wherein the stay is made from sheet metal and shaped substantially like a letter U as viewed in an axial direction of the tubular fusing member; and wherein surfaces of the first and second portions at the second side of the nip plate are disposed opposite to and supported by end faces of the stay, respectively, in an opposing direction of the backup member and the nip plate.

16. The fixing device according to claim 10, wherein the stay is made from sheet metal, and the nip plate has a thickness smaller than that of the stay.

17. The fixing device according to claim 10, further comprising a reflecting plate configured to reflect, toward the nip plate, radiation of heat received from the heating element, wherein each of the first and second portions of the nip plate is supported by the stay with the reflecting plate interposed between the each of first and second portions of the nip plate and the stay.

18. The fixing device according to claim 10, wherein the fusing member is a film.

* * * * *

UNITED STATES PATENT AND TRADEMARK OFFICE

CERTIFICATE OF CORRECTION

PATENT NO. : 8,489,007 B2
APPLICATION NO. : 12/915206
DATED : July 16, 2013
INVENTOR(S) : Yasushi Fujiwara et al.

It is certified that error appears in the above-identified patent and that said Letters Patent is hereby corrected as shown below:

On the title page item (75), line 3, under Inventors:
Please insert -- legal representative, -- after "Etsuko Fujiwara,"

Signed and Sealed this
Eighth Day of December, 2015

Michelle K. Lee

Michelle K. Lee
*Director of the United States Patent and Trademark Office*